United States Patent [19]

Guevel et al.

[11] Patent Number: 4,810,129

[45] Date of Patent: Mar. 7, 1989

[54] ARRANGEMENT FOR GENERATING WAVES IN A BODY OF WATER

[75] Inventors: Pierre Guevel, Chateauneuf De Grasse; Eric Landel, Antibes, both of France

[73] Assignee: Principia Recherche Developpement S.A., Valbonne, France

[21] Appl. No.: 55,792

[22] Filed: Jun. 1, 1987

[30] Foreign Application Priority Data

Dec. 4, 1986 [FR] France ..... 86 17113
Dec. 9, 1986 [FR] France ..... 86 17314

[51] Int. Cl.[4] ..... E02B 3/00
[52] U.S. Cl. ..... 405/79; 4/491
[58] Field of Search ..... 405/79, 52, 80; 4/491

[56] References Cited

U.S. PATENT DOCUMENTS 3,973,405 8/1976 Duport ..... 405/79
4,062,192 12/1977 Biewer ..... 405/79
4,507,018 3/1985 Anderson ..... 405/79

FOREIGN PATENT DOCUMENTS 163218 10/1933 Switzerland ..... 405/79

*Primary Examiner*—David H. Corbin
*Attorney, Agent, or Firm*—Frishauf, Holtz, Goodman & Woodward

[57] ABSTRACT

An arrangement for generating an artificial swell in a body of liquid contained in a container, such as a marine experimentation tank, a swimming pool, or the like, includes an elongated float parallel to a rear wall of the container and having such a cross section that a rear wall of the float is substantially vertical and generally parallel to the rear wall of the container and a front portion of the float has a nose-shaped configuration. A mechanical device is connected to the float and is operative for imparting an alternating horizontal motion to the float.

5 Claims, 2 Drawing Sheets

3,00
2,85
2,70
2,55
2,40
2,25
2,10
1,95
1,80
1,65
1,50
1,35
1,20
1,05
0,90
0,75
0,60
0,45
0,30
0,8
1,0
1,2
1,4
1,6
1,8
2,0
2,2
2,4
2,6
2,8
3,0
3,2
3,4
3,6
A
I
II
III
IV
V
VI

ARRANGEMENT FOR GENERATING WAVES IN A BODY OF WATER

BACKGROUND OF THE INVENTION

The present invention relates to arrangements for generating waves in bodies of water in general, and more particularly to wave generating arrangements to be used in marine engineering test tanks or in public or private swimming pools.

There are already currently known two basic types of wave generating arrangements which may be distinguished from one another by the type of "beater" which is used therein and which dynamically operates on the body of water in which an artificial swell is to be provided.

First of all, there may be mentioned wave generating arrangements utilizing "paddle" type beaters which may be either mounted for vertical displacement and driven to produce an alternating vertical translatory motion, or mounted for an angular displacement and driven to produce an alternating rocking motion. Such paddles are either articulated to or connected with a device for translating the paddle rocking shaft Studies carried out on these systems have shown that the transfer function thereof (i.e the ratio between the height of the swell produced and the height of the angular elongation of the paddle) are satisfactory only for double-acting systems and for short wave periods Furthermore, for technical reasons, such systems have only a low degree of attractiveness because of the mass to be moved, the difficulty of simultaneously controlling the movement of two rams (translation and rocking) and the technical complexities resulting from the need for providing and operating equipment that is required to ensure satisfactory sealing action between the paddles and the side walls of the channels in which the paddles are moving.

Secondly, there are to be mentioned "corner plunger" beaters which comprise a prism having a downwardly pointed triangular cross section, wherein one major surface of such a prism slides in an alternating motion over the length of the rear vertical wall of the channel The transfer function of this type of beater is not very satisfactory and, furthermore, such beaters cannot be adapted to very deep wave tanks in which the effects of both swell and current are to be simulated.

A new and more satisfactory solution was recently proposed This solution involves the use of a horizontally extending cylindrical float as a "beater". This float is sinusoidally actuated for movement in any one of three directions of motion.

Although this system produces a more satisfactory transfer function than those discussed above, it nevertheless has the disadvantage of being costly because of the complex method of operating the beater (ram and connecting-rod assembly).

SUMMARY OF THE INVENTION

Accordingly, it is a general object of the present invention to avoid the disadvantages of the prior art.

More particularly, it is an object of the present invention to provide a wave generating arrangement which does not possess the drawbacks of the known arrangements of this type.

Still another object of the present invention is to devise an arrangement of the type here under consideration which operates with a very high degree of efficiency.

It is yet another object of the present invention to design the above arrangement in such a manner as to be usable as easily in marine experimentation tanks as in swimming pools.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a wave generating arrangement which includes a float that is driven in a simple horizontal alternating motion and which is mounted at a suitable distance from the rear wall of the tank or swimming pool. This arrangement is by far less costly to manufacture, install, maintain and operate than the heretofore known wave generating arrangements and creates a swell having a transfer function that is by far more satisfactory than that produced by any of the previously known systems.

Further, it is an advantage in the creation of resonance phenomena which have favorable effects on the achievement of these results when the rear of the float is vertical.

The invention thus concerns a wave generating arrangement which comprises an elongated float that is transversely mounted in a tank or swimming pool, at a short distance from a rear vertical wall of the tank or swimming pool A generating curve of the elongated float has a more or less vertical section at its rear region, while a front region of the float is nose-shaped. The float is connected to an actuating device which is operative for subjecting the float to an alternating horizontal translation.

Owing to this arrangement, the mechanical devices employed in the wave generating arrangement are greatly simplified as compared to those employed in the heretofore proposed systems. As a matter of fact, such devices are reduced merely to a horizontal ram. Furthermore, the stresses encountered during the operation of the wave generating arrangement are also greatly reduced relative to those present in the known arrangements of this type.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
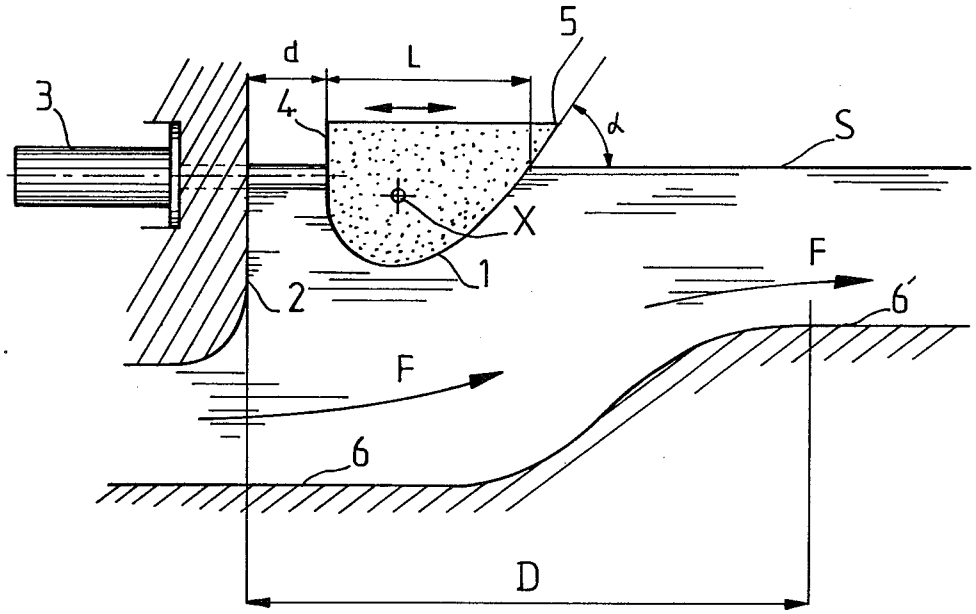
FIG. 1 is a schematic cross-sectional view of a wave generating arrangement in accordance with the invention.

Referring now to the drawing in detail, and first to FIG. 1 thereof, it may be seen that the reference numeral 1 has been used therein to identify an elongated float which extends parallel to a rear vertical wall 2 of a wave tank or a similar container, such as a swimming pool, that contains a body of water in which waves are to be generated. The float 1 is driven, in a manner which is already known, by a ram cylinder unit 3, to produce motion that is also known as rocking motion, that is, an alternating horizontal translation.

The cross section, and more particularly the generating curve, of the float 1 has the general form represented in FIG. 1, namely:

a rear face 4 of the float 1, that is the face facing the rear wall 2 of the container, is substantially vertical, as is the rear wall 2. The effects of this special feature and of the distance between these two vertical surfaces will be seen below;

a forward section 5 of the float 1 is nose-shaped to include an angle with an upper surface S of the body of water. This angle is a compromise between the highest possible value to obtain a good wave generating performance, and a low value to obtain a high degree of circulatory current regularity around the nose-shaped section 5 In the depicted case, where current flows in the channel in the direction indicated by an arrow F, the float 1 creates a current convergence with the difference in level between portions of the bottom wall of the container which are indicated at 6 and 6'.

Figure 2:
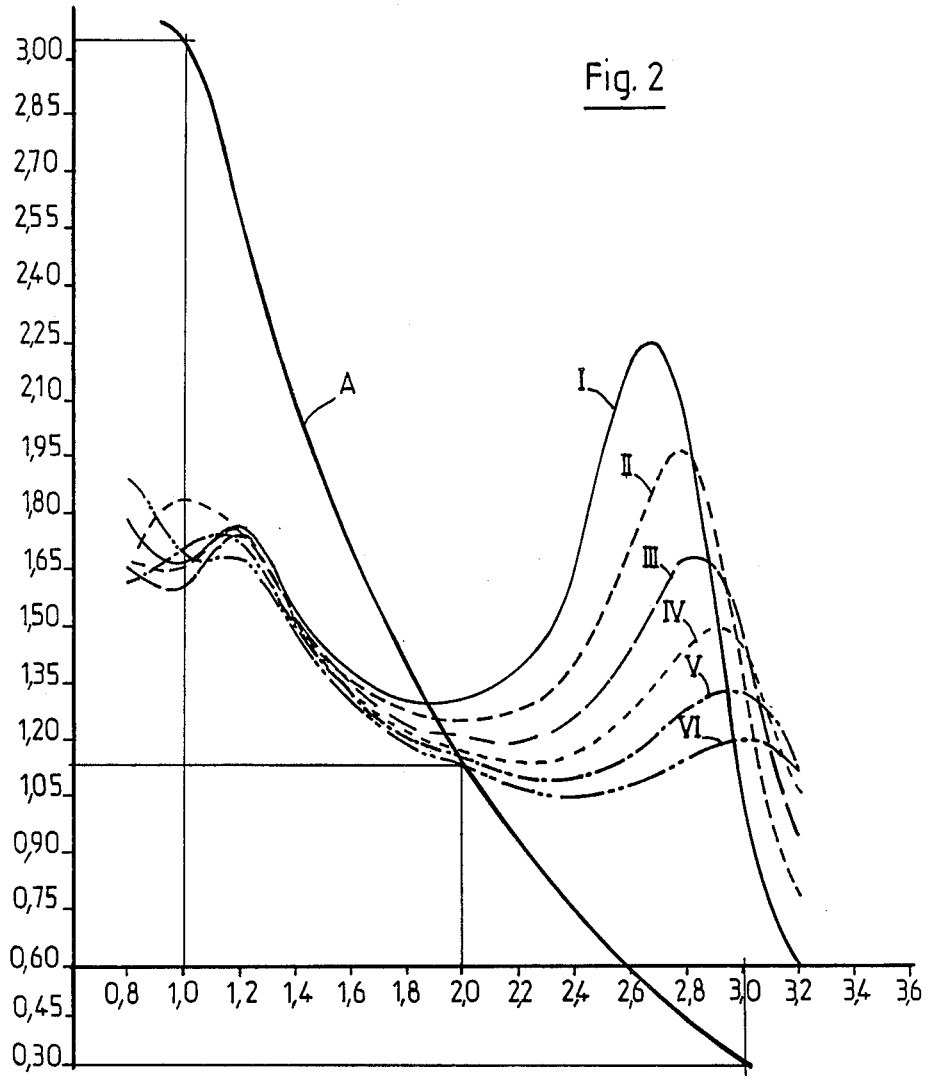
FIG. 2 is a diagram showing variations in a transfer function obtained during the operation of a specific implementation of the arrangement according to the present invention in dependence on the wave period.

Experience with this system has shown the possibility of attaining very high transfer functions, especially with wave periods around 2 to 3 seconds. FIG. 2 shows a diagram indicative of the influence exerted upon the transfer function values by the difference in distance d between the rear wall 4 of the float 1 and the rear wall 2 of the container, these effects being attributable to the occurrence of a resonance phenomenon arising from cyclic variations in this distance.

Curves I to VI of this diagram of FIG. 2 depict the transfer functions which correspond to various average values of the distance d as tabulated below for various periods of movement of the float. These curves have been obtained while utilizing the float 1 conforming to that of FIG. 1, having a waterline width of 1.9 meters and immersed to the extent of 1 meter into the body of water contained in a tank having a depth of 7 meters at the bottom wall portion 6 and of 3 meters at the bottom wall portion 6' which is located at a distance D amounting to 10 meters from the rear wall 2 of the tank.

| Curve | Average d (m) |
|---|---|
| I | .6 |
| II | .7 |
| III | .8 |
| IV | .9 |
| V | 1.9 |
| VI | 2.0 |

These curves I to VI are to be compared to a curve A which illustrates corresponding variations in the transfer function which have been obtained while utilizing a similar float 1 but oscillating around a transversal shaft X rather than being horizontally displaced.

It is clear that the system in accordance with the invention produces the most favorable transfer functions within the wave periods desirable for the tanks under consideration. This further shows that the hydrodynamic performance of the system differs radically from that of earlier systems which could be compared geometrically.

It should be noted that even though these results can be attributed to the resonance phenomenon mentioned above, which is created by the piston effect that the float 1 exerts upon the water mass present between the rear wall 2 of the tank and the rear wall 4 of the float 1, which implies float verticality, it is possible within the scope of the invention to provide and use a float 1 in which the float rear wall 4 slopes slightly forwardly of the vertical. This would then offer the additional advantage of limiting wave lapping between the float 1 and the tank wall 2, without diminishing the transfer function.

It may be seen from the above that the new wave generating system in accordance with the invention offers a set of new and interesting characteristics when used in a marine experimentation tank:

high transfer function, simplicity of the mechanical system, good compliance with the imperatives connected with current generation in a tank, low hydrodynamic stresses exerted on the ram by the float owing to the added negative mass of water around the resonance period (2 to 3 seconds) which allows limitation of the inertial loads which must be developed by the ram to activate the float.

While the present invention has been described above as used particularly in a marine experimentation tank, it is to be understood that the system of the present invention may as well be used in leisure facilities, such as public or private swimming pools, aquatic centers and the like.

So, for instance, the float 1 of the construction and configuration depicted in FIG. 1 of the drawing may be used in a rectangular swimming pool having the dimensions of 18 times 50 meters and a depth of 2 meters, without water circulation.

In this case, the float 1 may have a width L at the level of the upper surface S of the body of water of 1.914 meters, and the rear wall 4 of the float 1 which faces the rear wall 2 of the swimming pool is planar and vertical, extending to the elevation of 0.5 meters below the water surface S.

The bottom of the float 1 is constituted by a horizontal cylinder having a center X and a radius of 0.5 meters. Thus, the submerged depth of the float 1 into the body of water is 1 meter. The bottom of the front part of the float 1 is also configured as a cylinder, but the radius of this cylinder is 1.5 meters and the center thereof is situated 1 meter vertically upwardly of the point X. The angle of the float 1 is 69°.

The mean distance d of the rear wall 4 of the float 1 from the rear wall 2 of the swimming pool varies between 0.6 and 1 meters.

The float 1 is excited or horizontally moved mainly by the hydraulic unit 3. The unit 3 imposes on the float 1, for instance, a sinusoidal movement having a period varying between 1 and 3 seconds and an amplitude of 0.37 meters. For a distance d=0.8 meters, there are obtained waves having a height of 1 meter, a period of 1.4 seconds, and an amplitude of 0.37 meters, corresponding to the waves which are frequently encountered in nature.

It will be appreciated that the parameters mentioned above can be modified in such a manner as to obtain waves having different characteristics. It is possible to establish the quantitative relationships between the various parameters governing the satisfactory functioning of the system according to the present invention, particularly in swimming pools and the like.

It has been established that, when the system according to the present invention is to be employed in swimming pools having widths between 8 and 33 meters, lengths between 30 and 100 meters, and depths between 0.5 and 3 meters, the following system parameters are to be used:

The mean distance between the rear wall 2 of the swimming pool and the rear wall 4 of the float 1 is to be between 0.1 and 2 meters; the flotation width L of the float I at the level S is to be between 0.25 and 3 meters; the angle of the nose-shaped front portion of the float 1 is to be between 15 and 70 degrees; the submerged depth of the float 1 is to be between 0.1 and 2 meters; the excitation period of the float 1, that is, the sinusoidal displacement which is to be imposed on the float 1, is to be between 0.5 and 4 seconds; and the amplitude of the sinusoidal movement is to be between 0.05 and 1.5 meters.

It is also to be mentioned that the height, that is, the Vertical extension, Of the rear wall 2 of the swimming pool and/or that of the rear wall 4 of the float 1, upwardly of the upper surface S of the body of water contained in the swimming pool may advantageously exceed the height of other components or portions of the swimming pool and/or of the float 1. It will be appreciated that this constitutes an additional precaution, particularly for the prevention of overflow of the water from the zone situated between the rear wall 2 of the swimming pool and the rear wall 4 of the float 1, which gives rise to the phenomena on which the present invention is based.

While the present invention has been described and illustrated herein as embodied in a specific construction of a wave generating arrangement, it is not limited to the details of this particular construction, since various modifications and structural changes are possible and contemplated by the present invention Thus, the scope of the present invention will be determined exclusively by the appended claims.

What is claimed is:

1. An arrangement for generating an artificial swell in a body of liquid contained in a container including a rear wall, comprising an elongated float parallel to the rear wall of the container and having such a cross section that a rear wall of said float is substantially vertical and generally parallel to the rear wall of the container and a front portion of said float has a nose-shaped configuration; and a mechanical device connected to said float and operative for imparting an alternating horizontal motion to said float.

2. The arrangement as defined in claim 1, wherein a mean distance between the rear wall of said float and the rear wall of the container is so selected that a resonance phenomenon is created between the wave train provoked by the oscillations of the water column between such rear walls and created by the motion of the float itself, the superposition of the two wave trains giving rise to a very high transfer function for a selected wave period interval.

3. The arrangement as defined in claim 1 for use particularly in public and private swimming pools having widths of between 8 and 33 meters, lengths of between 30 and 100 meters, and depths between 0.5 and 3 meters, wherein the mean distance between the rear wall of the container and the rear wall of the float is between 0.1 and 2 meters, the flotation width of the float at the level of the body of liquid is between 0.25 and 3 meters, the angle of the nose-shaped front portion of the float is between 15 and 70 degrees, the submerged depth of the float is between 0.1 and 2 meters, the period of the sinusoidal movement imposed on the float is between 0.5 and 4 seconds, and the amplitude of the sinusoidal movement is between 0.05 and 1.5 meters.

4. The arrangement as defined in claim 3 for use particularly in a public and private swimming pool having a width of about 18 meters, a length of about 50 meters, and a depth of about 2 meters, wherein the mean distance between the rear wall of the container and the rear wall of the float varies between about 0.6 and 1 meters, the flotation width of the float at the level of the body of liquid is about 1.914 meters, the rear wall of the float is substantially planar and vertical and extends to the depth of about 0.5 meters below the water surface and the bottom of the float is constituted by a horizontal cylinder having having a center and a radius of about 0.5 meters to give a total submerged depth of the float of about 1 meter, the bottom of the front part of the float is also configured as a but with a radius of about 1.5 meters and having an cylinder other center situated about 1 meter vertically upwardly of said center, the angle of the nose-shaped front portion of the float is about 69 degrees, the period of the sinusoidal movement imposed on the float is between 1 and 3 seconds, and the amplitude of the sinusoidal movement is about 37 meters.

5. An arrangement for generating an artificial swell in a body of liquid contained in a container having a bottom, a front wall, and a rear wall, comprising an elongated float spaced above from the bottom of the body of liquid and having a cross-section such that a rear wall of said float is aligned at an angle between vertical and slightly inclined forward from the vertical, to eliminate wave lapping between the rear wall and the float, and wherein a front portion of said float has a nose-shaped configuration; and a mechanical device connected to said float and operative for imparting an alternating horizontal motion to said float, whereby a resonance phenomenon is created to due to water wave trains between the rear wall of the container and the rear wall of the float, on one hand, and a front portion of the float, on the other hand, due to the movement of the body of liquid therebetween.

* * * * *